US011712794B1

(12) United States Patent
Lai

(10) Patent No.: US 11,712,794 B1
(45) Date of Patent: Aug. 1, 2023

(54) TOOL-HANGING APPARATUS

(71) Applicant: Yi-Hsuan Lai, Taichung (TW)

(72) Inventor: Yi-Hsuan Lai, Taichung (TW)

( * ) Notice: Subject to any disclaimer, the term of this patent is extended or adjusted under 35 U.S.C. 154(b) by 0 days.

(21) Appl. No.: 17/858,048

(22) Filed: Jul. 5, 2022

(51) Int. Cl.

| | |
|---|---|
| ***B65D 73/00*** | (2006.01) |
| ***B25H 3/00*** | (2006.01) |
| ***A47F 7/00*** | (2006.01) |
| *A47F 5/00* | (2006.01) |

(52) U.S. Cl.
CPC ..... *B25H 3/003* (2013.01); *A47F 7/0028* (2013.01); *B65D 73/0014* (2013.01); *B65D 73/0064* (2013.01); *A47F 5/0006* (2013.01)

(58) Field of Classification Search
CPC ... B25H 3/003; A47F 7/0028; B65D 73/0014; B65D 73/0064
See application file for complete search history.

(56) References Cited

U.S. PATENT DOCUMENTS

| | | | | |
|---|---|---|---|---|
| 6,375,005 | B1 * | 4/2002 | McCann | B65D 73/0064 206/349 |
| 6,409,015 | B1 * | 6/2002 | Hu | B65D 73/0064 206/349 |
| 7,494,018 | B2 * | 2/2009 | Wu | B65D 73/0064 211/70.6 |
| 7,527,149 | B2 * | 5/2009 | Wu | B65D 73/0064 206/349 |
| 7,565,973 | B2 * | 7/2009 | Chang | B65D 73/0064 248/689 |
| 7,624,865 | B2 * | 12/2009 | Pendergraph | B65D 73/0064 206/349 |
| 8,281,925 | B2 * | 10/2012 | Chang | B25H 3/04 206/349 |
| 8,794,110 | B2 * | 8/2014 | Kriz | B25B 13/56 81/124.5 |
| 10,398,237 | B2 * | 9/2019 | Chen | A47F 5/0006 |
| 11,376,725 | B1 * | 7/2022 | Hsieh | B25H 3/003 |
| 2002/0027092 | A1 * | 3/2002 | Hu | B65D 73/0064 206/349 |
| 2007/0007156 | A1 * | 1/2007 | Wu | B65D 73/0064 206/349 |
| 2007/0163915 | A1 * | 7/2007 | Wu | B65D 73/0014 206/495 |

(Continued)

FOREIGN PATENT DOCUMENTS

| | | |
|---|---|---|
| TW | M463642 | 10/2013 |
| TW | I530374 | 4/2016 |

*Primary Examiner* — Kimberley S Wright
(74) *Attorney, Agent, or Firm* — Bruce Stone LLP; Joseph A. Bruce

(57) ABSTRACT

A tool-hanging apparatus includes a hanger and a rotor. The hanger includes a ring, an inward flange formed on a rear internal section of the ring, and teeth formed on a front internal section of the ring. An internal diameter of the inward flange is smaller than a diameter of a circular defined by the teeth. The rotor includes elastic strips extending from a tube. Each of the elastic strips includes a groove between a ridge and a barb. One of the elastic strips includes a tooth extending from the ridge of the same. When the rotor is inserted in the ring, the grooves of the elastic strips receive the inward flange to keep the rotor in the ring and allow the rotor to rotate relative to the ring. The tooth is engageable with the teeth to keep the rotor at an angle relative to the ring elastically.

10 Claims, 6 Drawing Sheets

(56) References Cited

U.S. PATENT DOCUMENTS

| | | | | |
|---|---|---|---|---|
| 2008/0272017 | A1* | 11/2008 | Chang | B65D 73/0064 206/349 |
| 2009/0026105 | A1* | 1/2009 | Wu | B65D 73/0064 206/349 |
| 2012/0074009 | A1* | 3/2012 | Chang | B25H 3/04 206/349 |
| 2012/0091074 | A1* | 4/2012 | Chang | B65D 73/0014 211/4 |
| 2017/0082127 | A1* | 3/2017 | Chen | B65D 73/00 |
| 2018/0310728 | A1* | 11/2018 | Chen | A47F 7/0021 |
| 2019/0062019 | A1* | 2/2019 | Christopher | B65D 73/0092 |

* cited by examiner

TOOL-HANGING APPARATUS

BACKGROUND OF INVENTION

1. Field of Invention

The present invention relates to a tool and, more particularly, to a tool-hanging apparatus for hanging a tool such as a one-way wrench so that the tool can be tried or tested while hung on the tool-hanging apparatus.

2. Related Prior Art

Taiwanese Patent M463642 discloses a tool-hanging apparatus including two hangers 1 and 2, a rotational element 3, and a cover 4. The hanger 1 includes a connective portion 13 connected to a connective portion 21 of the hanger 2. The rotational element 3 is connected to the connective portion 13 of the hanger 1 and the connective portion 21 of the hanger 2. The cover 4 is engageable with the hanger 2 to provide a space 41.

A section of a handle of a tool such as a one-way wrench 5 is inserted in the space 41 so that the one-way wrench 5 is hung on the hanger. A square tongue 51 extending from a head of the one-way wrench 5 is inserted in a square bore 33. A customer is allowed to pivot the one-way wrench 5 to and fro to rotate the rotational element 3 on and off Thus, the customer is allowed to try the one-way wrench 5 without having to take the one-way wrench 5 from the tool-hanging apparatus.

However, the tool-hanging apparatus includes a lot of elements. It requires a complicated process, takes a lot of time, and costs a lot of money to assemble the tool-hanging apparatus.

Taiwanese Patent 1530374 discloses another tool-hanging apparatus including a hanger 1, an anti-theft block 2, and a restraining element 3. The hanger 1 includes a flat portion 11 and an annular portion 12.The annular portion 12 of the hanger 1 includes an orifice 121, an inward flange 122 extending along a wall of the orifice 121, and teeth 123 formed on the inward flange 122.

The anti-theft block 2 includes an end inserted in the orifice 121 of the hanger 1 and another end located out of the orifice 121 of the hanger 1. The anti-theft block 2 includes four fins 25, two fins 26, two teeth 27, and two slits 28. The fins 25 extend in a plane. The fins 26 extend in another plane. The teeth 27 are arranged between the planes. Each of the slits 28 extends between corresponding two of the fins 25. The slits 28 extend between the fins 26. The slits 28 allow the anti-theft block 2 to be deformed to allow the fins 25 to be moved past the inward flange 122 in a forward direction. Thus, the fins 25 are in contact with a front face of the inward flange 122 while the fins 26 are in contact with a rear of the inward flange 122, thereby keeping the anti-theft block 2 in the orifice 121 of hanger 1. The teeth 27 are engageable with the teeth 123.

A square tongue 20 of a one-way wrench 10 is inserted in a square bore 21 in the anti-theft block 2. A detent 40 in the form of a ball biased by a spring is substantially inserted in a recess 30 in the square tongue 20, with a portion of the ball 40 located out of the recess 30. A customer is allowed to pivot the one-way wrench 10 to and fro to rotate the anti-theft block 2 on and off Thus, the customer is allowed to try the one-way wrench 10 without having to take the one-way wrench 10 from the tool-hanging apparatus.

Moreover, a restraining element 3 is connected to a portion of the anti-theft block 2 that is located out of the orifice 121. The anti-theft block 2 further includes a slot 22 in communication with the square bore 21. The restraining element 3 includes an inserting portion 31 inserted in the square bore 21 through the slot 22. The inserting portion 31 of the restraining element 3 is further inserted in the recess 30. Thus, the square tongue 20 cannot be detached from the anti-theft block 2 without moving the inserting portion 31 of the restraining element 3 from the recess 30.

However, the making of the restraining element 3 inevitably increases the cost of the tool-hanging apparatus. Moreover, the use of the restraining element 3 renders it troublesome to use the tool-hanging apparatus to hang the one-way wrench 10.

The present invention is therefore intended to obviate or at least alleviate the problems encountered in the prior art.

SUMMARY OF INVENTION

It is the objective of the present invention to provide an easy-to-assemble and inexpensive tool-hanging apparatus.

To achieve the foregoing objective, the tool-hanging apparatus includes a hanger and a rotor. The hanger includes a ring, an inward flange formed on a rear internal section of the ring, and teeth formed on a front internal section of the ring. An internal diameter of the inward flange is smaller than a diameter of a circular defined by the teeth. The rotor includes elastic strips extending from a tube. Each of the elastic strips includes a groove between a ridge and a barb. One of the elastic strips includes a tooth extending from the ridge of the same. When the rotor is inserted in the ring, the grooves of the elastic strips receive the inward flange to keep the rotor in the ring and allow the rotor to rotate relative to the ring. The tooth is engageable with the teeth to keep the rotor at an angle relative to the ring elastically.

Other objectives, advantages and features of the present invention will be apparent from the following description referring to the attached drawing.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
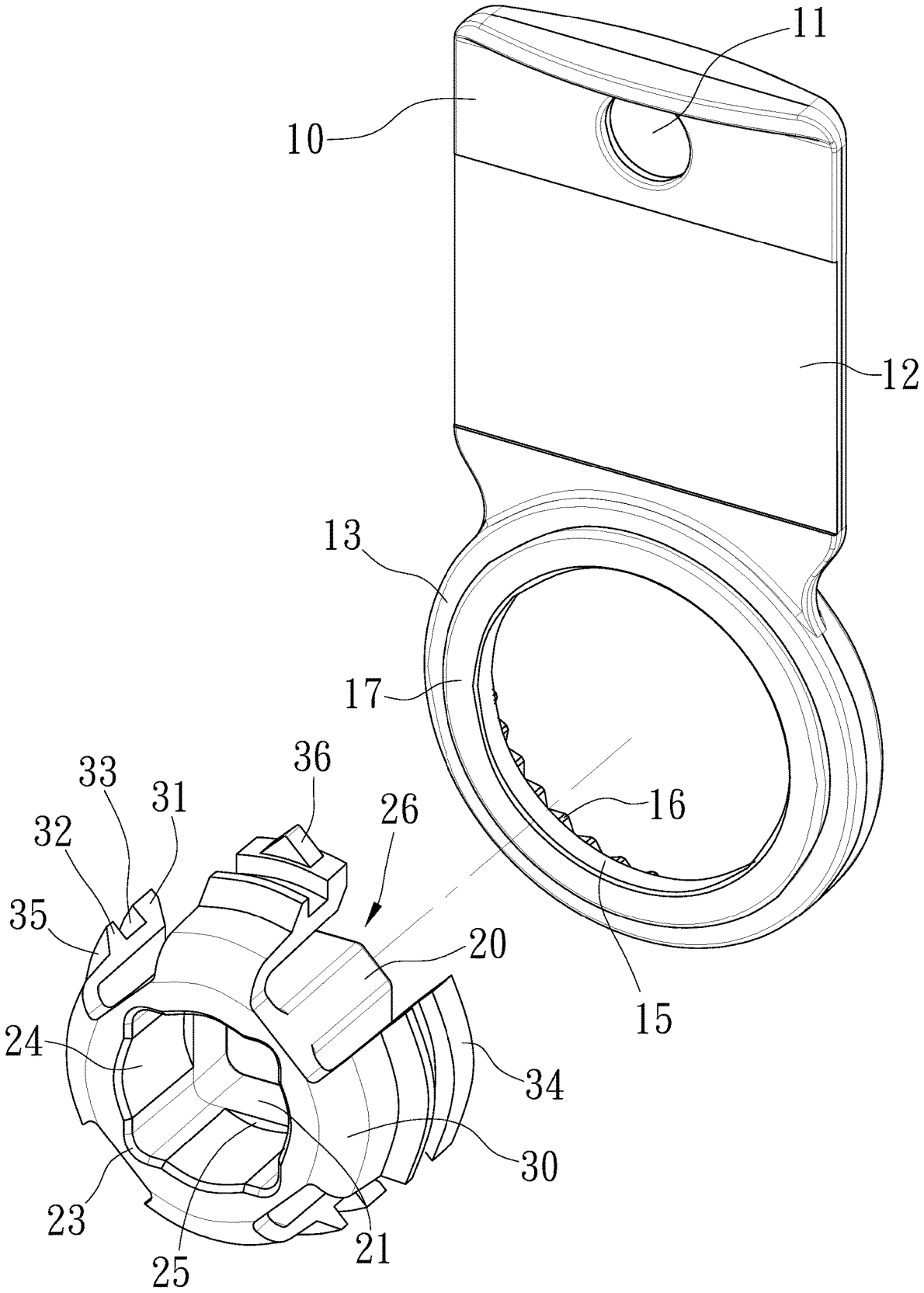
FIG. 1 is an exploded view of a tool-hanging apparatus according to the preferred embodiment of the present invention.
Figure 2:
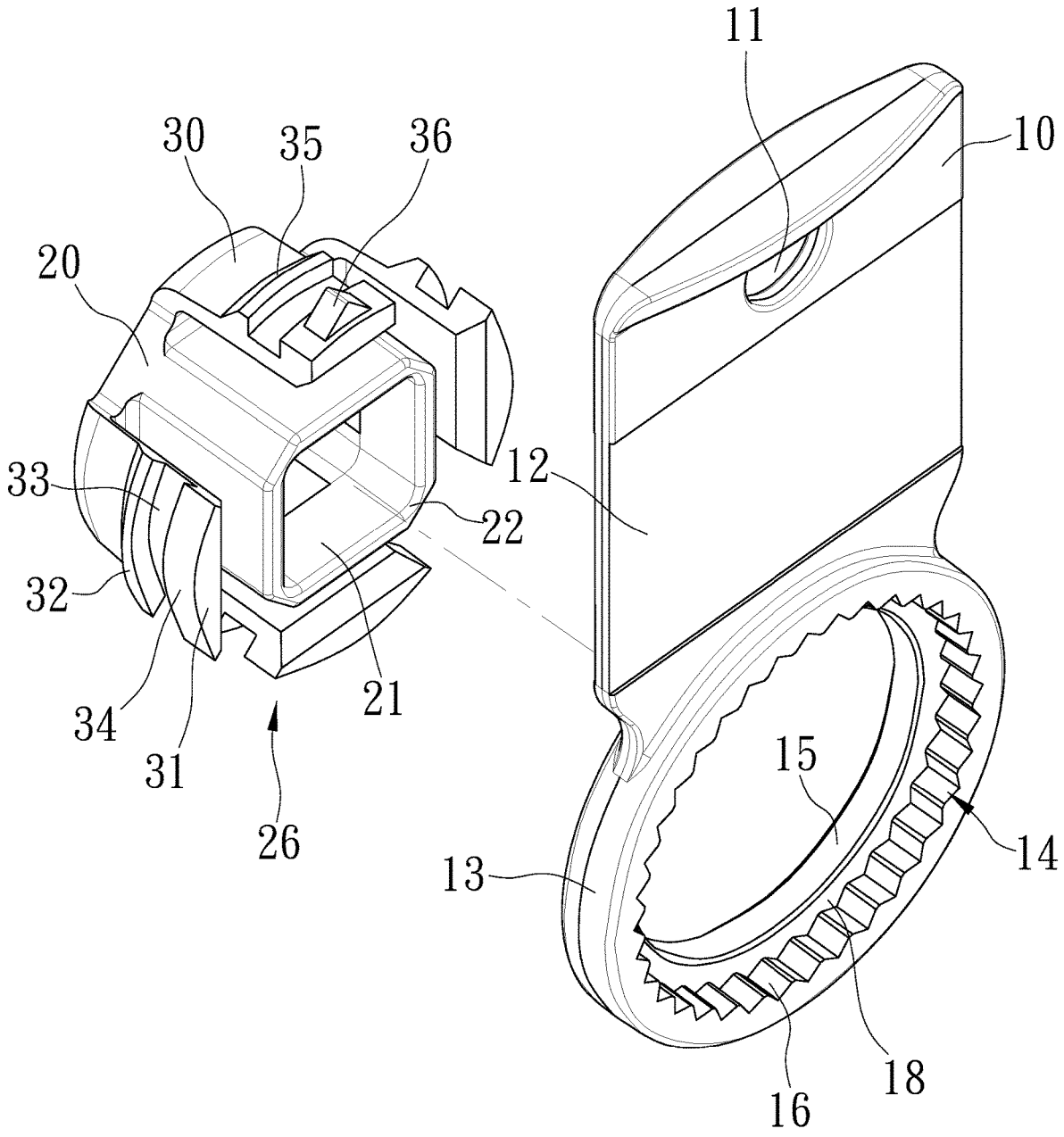
FIG. 2 is another exploded view of the tool-hanging apparatus shown in FIG. 1.

Referring to FIGS. 1 and 2, a tool-hanging apparatus includes a hanger 10 and a rotor 26 according to the preferred embodiment of the present invention. The hanger 10 includes an orifice 11 in an upper portion, a sticker-supporting portion 12 on a middle portion, and a ring 13 on a lower portion. The orifice 11 can receive a nail on a wall for example.

The sticker-supporting portion 12 includes a front face (not numbered) and a rear face (not numbered). A sticker (not shown) can be adhered to the front face of the sticker-supporting portion 12. Similarly, another sticker (not shown) can be adhered to the rear face of the sticker-supporting portion 12. Such stickers display data about a tool 40 (FIGS. 5 and 6) hung on the tool-hanging apparatus. Preferably, the front face of the sticker-supporting portion 12 is dropped from a front face of the remaining portion of the hanger 10, and the rear face of the sticker-supporting portion 12 is dropped from a rear face of the remaining portion of the hanger 10.

The ring 13 is used to receive the rotor 26. The ring 13 includes an orifice 14, an inward flange 15 extending along a wall of the orifice 14, and teeth 16 formed on the wall of the orifice 14. The inward flange 15 includes an annular rear face 17 and an annular front face 18. The flange 15 is located behind of the teeth 16. That is, the teeth 16 are located against the front face 18 of the inward flange 15.

The rotor 26 includes four elastic strips 30 extending from a tube 20. The tube 20 includes a front aperture 22 and a rear aperture 23. The front aperture 22 is a square aperture defined by four planar facets 21. The rear aperture 23 is defined by four concave facets 24. There is an adjoining facet 25 between each of the planar facets 21 and a corresponding one of the concave facets 24. That is, there are four adjoining facets 25.

The tube 20 includes a square profile formed with four external planar facets (not numbered). Each of the elastic strips 30 extends from a corresponding one of the external planar facets of the tube 20.

Each of the elastic strips 30 extends from the corresponding external planar facets of the tube 20, and bends and extends parallel to the corresponding external planar facet of the tube 20. Each of the elastic strips 30 includes a ridge 31 and a barb 32 on a front section. The ridge 31 includes a convex facet 34. A tooth 36 extends from the convex facet 34 of the ridge 31 of one of the elastic strips 30. The barb 32 is separated from the ridge 31 by a groove 33. The barb 32 is formed with a slant facet 35 opposite to the groove 33. The slant face 35 is a rear face of the barb 32 for a reason to be described.

Figure 3:
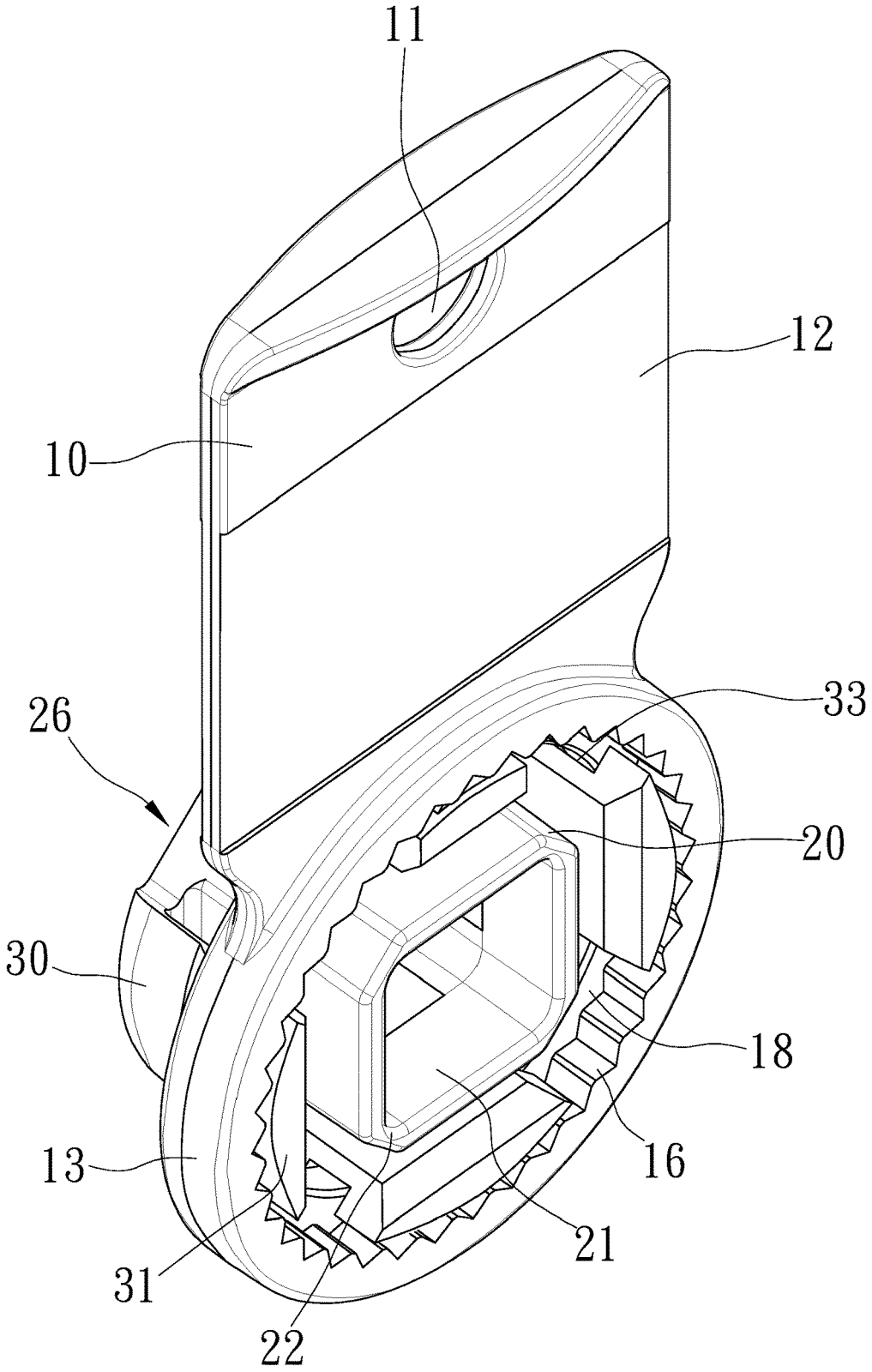
FIG. 3 is a perspective view of the tool-hanging apparatus shown in FIG. 2.
Figure 4:
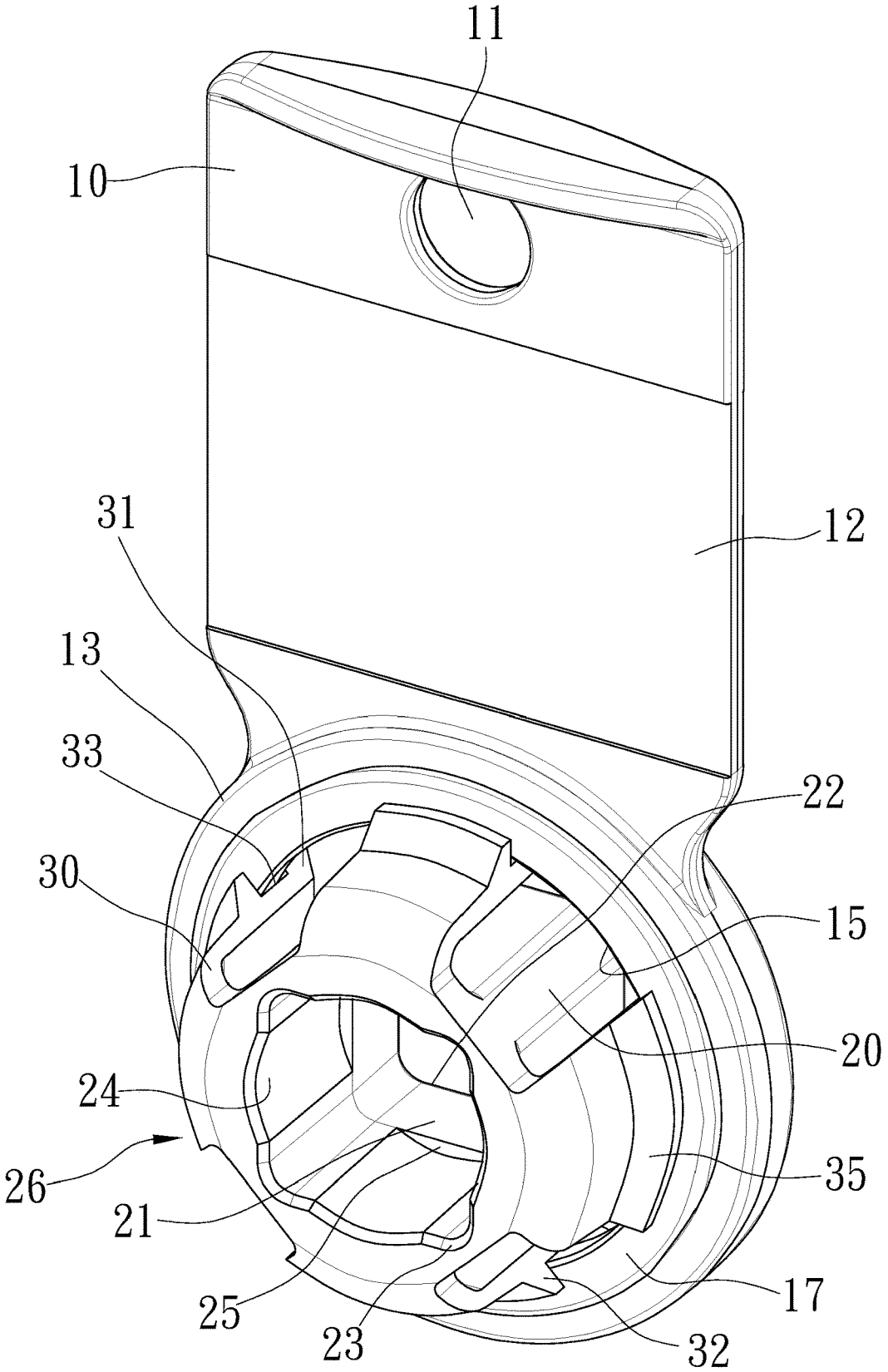
FIG. 4 is a perspective view of the tool-hanging apparatus shown in FIG. 1.

Referring to FIGS. 3 and 4, the rotor 26 is inserted in the ring 13. During the insertion, the slant facets 35 facilitate rearward movement of the barbs 32 past the inward flange 15. During the rearward movement, the elastic strips 30 are pivoted toward the tube 20. Once the barbs 32 move past the inward flange 15, the elastic strips 30 pivot outward or restore their original shape so that the grooves 33 receive the inward flange 15, i.e., that inward flange 15 is inserted in the grooves 33. The inward flange 15 is confined between the barbs 32 and the ridges 31. The ridge 31 is inserted in the orifice 14. Thus, the rotor 26 is kept in the ring 13. Now, the front aperture 22 is located coaxially in the orifice 14.

Figure 5:
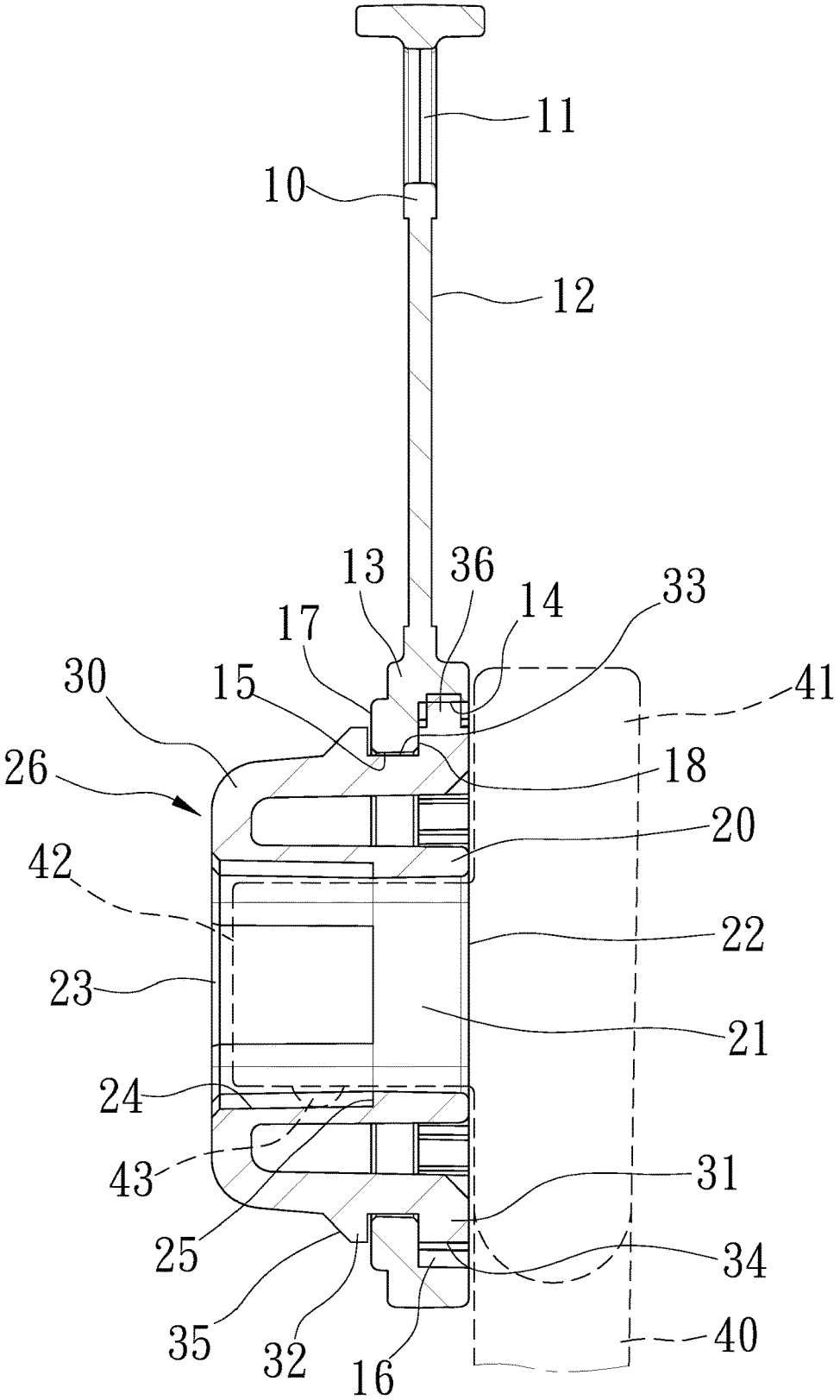
FIG. 5 is a cross-sectional view of the tool-hanging apparatus shown in FIGS. 3 and 4.

Referring to FIG. 5, the inward flange 15 is inserted in the grooves 33 and the ridges 31 are in contact with the front face 18 of the inward flange 15 while the barbs 32 are in contact with the rear face 17 of the inward flange 15. Thus, the rotor 26 is not allowed to move axially relative to the ring 13. However, the rotor 26 is allowed to rotate relative to the ring 13. In an elastic manner, the tooth 36 is engageable with the teeth 16 to keep the rotor 26 at an angle relative to the ring 13.

A one-way wrench 40 includes a head 41, a square tongue 42 extending from the head 41, and a spring-biased ball 43 including a larger portion inserted in the square tongue 42 and a smaller portion extending from the square tongue 42. The square tongue 42 is inserted in the rear aperture 23 via the front aperture 22. One of the concave facets 24 is in contact with the ball 43. The head 41 is placed against the ring 13. Thus, the tool-hanging apparatus hangs the one-way wrench 40. In an attempt to move the square tongue 42 out of the rear aperture 23 through the front aperture 22, one of the adjoining facets 25 abuts against the ball 43, thereby preventing the attempt.

Figure 6:
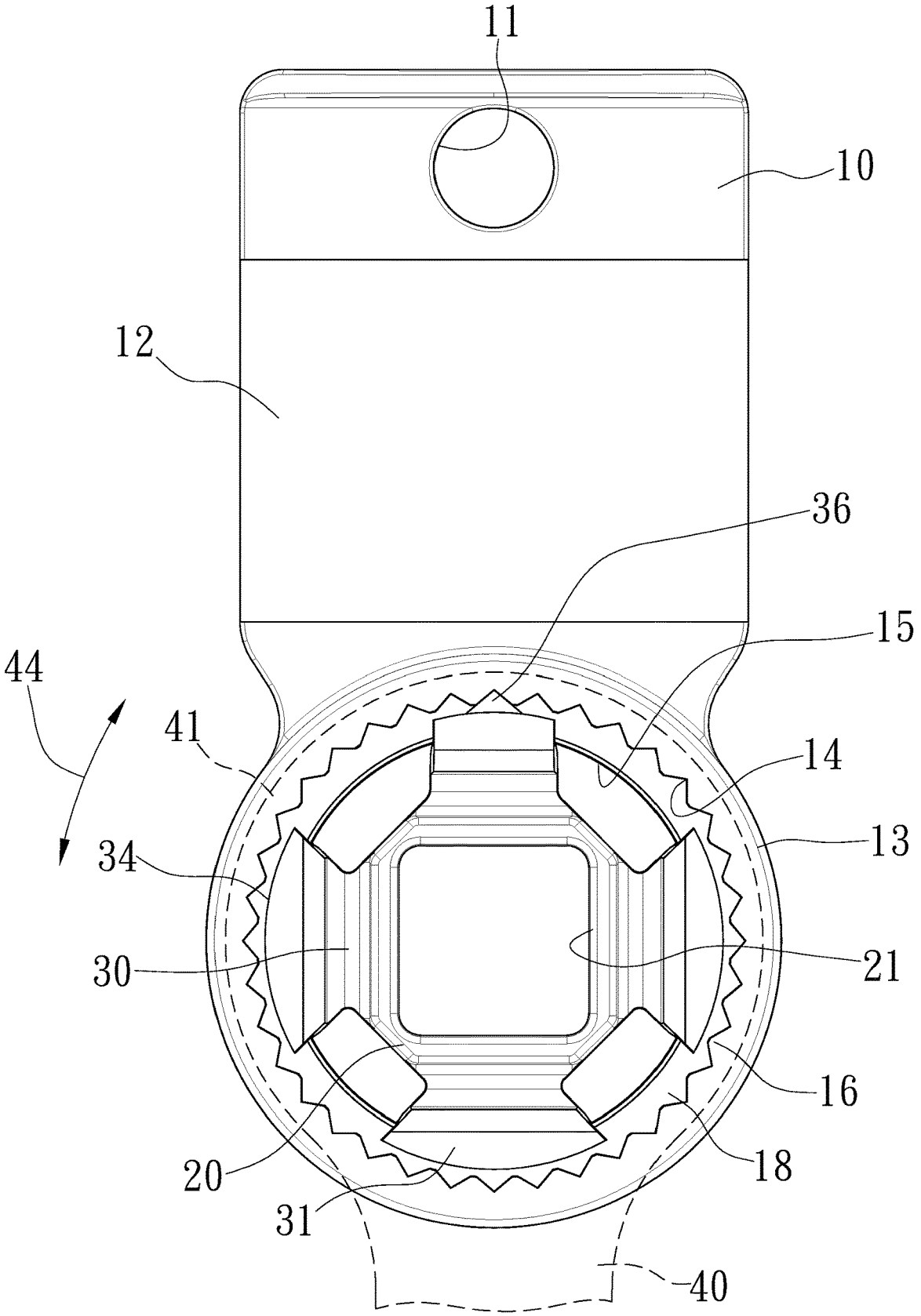
FIG. 6 is a rear view of the tool-hanging apparatus shown in FIGS. 3 and 4.

Referring to FIG. 6, the one-way wrench 40 is rotated relative to the ring 13 in a direction indicated by an arrowhead 44. The square tongue 42 is not rotated relative to the head 41, i.e., they are rotatable together. The one-way wrench 40 rotates the rotor 26 relative to the ring 13 while tooth 36 rattles on the teeth 16. Thus, a customer is allowed to try the one-way wrench 40 to determine whether he or she likes the one-way wrench 40 without having to detach the one-way wrench 40 from the tool-hanging apparatus.

The one-way wrench 40 can be rotated relative to the ring 13 in a direction opposite to the direction indicated by an arrowhead 44, the head 41 is allowed to rotate relative to the square tongue 42, which is now kept at an angle by the ring 13 due to the engagement of the tooth 36 with the teeth 16.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A tool-hanging apparatus comprising:

a hanger comprising a ring, an inward flange formed on a rear internal section of the ring, and teeth formed on a front internal section of the ring, wherein an internal diameter of the inward flange is smaller than a diameter of a circular defined by the teeth; and a rotor comprising a tube and elastic strips extending from the tube, wherein each of the elastic strips comprises a ridge, a barb, and a groove between the ridge and the barb, wherein one of the elastic strips comprises a tooth extending from the ridge of the same, wherein when the rotor is inserted in the ring, the grooves of the elastic strips receive the inward flange to keep the rotor in the ring and allow the rotor to rotate relative to the ring, and wherein the tooth is engageable with the teeth to keep the rotor at an angle relative to the ring elastically.

2. The tool-hanging apparatus according to claim 1, wherein the barb of each of the elastic strips comprises a slant facet slidable on the inward flange to facilitate movement of the barb into the groove past the inward flange.

3. The tool-hanging apparatus according to claim 1, wherein the ridge of each of the elastic strips is inserted in the orifice to allow the tooth to engage with any two of the teeth.

4. The tool-hanging apparatus according to claim 1, wherein the tube comprises a front aperture defined by four planar facets, and wherein the planar facets are in contact with four planar facets of a square tongue extending from a one-way wrench when the front aperture receives the square tongue.

5. The tool-hanging apparatus according to claim 4, wherein the tube further comprises a rear aperture in communication with the front aperture, wherein the rear aperture is defined by four concave facets, and wherein one of the concave facets is in contact with a spring-biased ball connected to the square tongue.

6. The tool-hanging apparatus according to claim 4, wherein the tube comprises four adjoining facets each of which extends between a corresponding one of the concave facets and a corresponding one of the planar facets, and wherein one of the adjoining facets abuts against the spring-biased ball to keep the square tongue in the front and rear apertures.

7. The tool-hanging apparatus according to claim 1, wherein the hanger comprises an orifice opposite to the ring.

8. The tool-hanging apparatus according to claim 6, wherein the hanger further comprises a sticker-supporting portion form with two faces each of which is used for contact with a sticker.

9. The tool-hanging apparatus according to claim 8, wherein each of the faces of the sticker-supporting portion is dropped from a face of the remaining portion of the hanger.

10. The tool-hanging apparatus according to claim 1, wherein the inward flange comprises a rear face and a front face, and wherein the front and rear faces respectively contact with the ridges and the barb as the grooves receive the inward flange.

* * * * *